United States Patent [19]

Massa

[11] Patent Number: 4,909,266

[45] Date of Patent: Mar. 20, 1990

[54] ULTRASONIC CLEANING SYSTEM

[75] Inventor: Frank Massa, 280 Lincoln St., Hingham, Mass. 02043-1796

[73] Assignees: Frank Massa; Donald P. Massa; Gitta M. Kurlat, all of Cohasset, Mass. ; Trustees of The Stoneleigh Trust u/d/t

[21] Appl. No.: 321,589

[22] Filed: Mar. 10, 1989

[51] Int. Cl.[4] ..... B08B 3/04

[52] U.S. Cl. ..... 134/60; 134/111; 134/184

[58] Field of Search ..... 134/60, 111, 184, 188, 134/56 R, 57 R, 1; 68/3 SS

[56] References Cited

U.S. PATENT DOCUMENTS

| | | | |
|---|---|---|---|
| 2,888,939 | 6/1959 | Nitsche | 68/3 SS X |
| 2,891,176 | 6/1959 | Branson | 68/3 SS X |
| 2,985,003 | 5/1961 | Gefand et al. | 68/3 SS |
| 2,994,165 | 8/1961 | Brevik | 68/3 SS X |
| 3,001,769 | 9/1961 | Plassmeyer | 68/3 SS X |
| 3,117,768 | 1/1964 | Carlin | 68/3 SS X |
| 3,371,233 | 2/1968 | Cook | 134/184 X |
| 3,640,295 | 2/1972 | Peterson | 134/184 X |
| 3,702,795 | 11/1972 | Wessells et al. | 134/184 X |
| 3,893,869 | 7/1975 | Mayer et al. | 134/184 |
| 4,333,485 | 6/1982 | Karlsson et al. | 134/184 |

*Primary Examiner*—Frankie L. Stinson

[57] ABSTRACT

An improved ultrasonic cleaning system employs a plurality of electroacoustic transducers located at different positions on the wall surfaces of a tank containing a cleaning liquid in combination with a source of electrical power and a selective switching system. The switching system applies the electrical power selectively, sequentially and intermittently to any specified one or more of said plurality of electroacoustic transducers to achieve substantially increased cavitation intensity levels in the cleaning liquid and thereby greatly improves the cleaning efficiency of the inventive system as compared to the conventional ultrasonic cleaners which are in widespread use.

20 Claims, 1 Drawing Sheet

ULTRASONIC CLEANING SYSTEM

This invention is concerned with improvements in an ultrasonic cleaning system. The generation of intense ultrasonic energy sufficient to cause cavitation in a cleaning liquid has been used for half a century as a method for cleaning objects that are immersed in the liquid. Applicant has found that during the first few seconds after turning on the ultrasonic transducer, the rate of removal of dirt from the surfaces of the objects being cleaned is very much greater than during the following period of continuous cavitation in the liquid. During Applicant's experimental investigation of this phenomenon it appears that during the initial first few seconds after turning on the ultrasonic power the initial intensity level is significantly higher than the steady state cavitation level. This appears to be due to the fact that the onset of cavitation in the liquid is not instantaneous; there is a small time delay involved in breaking the molecular bond between the quiescent liquid molecules. When cavitation occurs, the steady state intensity level in the liquid decreases and the cleaning efficiency is reduced. The inventive ultrasonic cleaning system takes advantage of this observed phenomenon by using a plurality of ultrasonic transducers to insonify the liquid and to cyclically switch the transducers on and off to obtain a repetitive series of increased intensity bursts of ultrasonic energy in the cleaning liquid.

The primary object of this invention is to design an improved ultrasonic cleaning system in which the removal of soil from objects being cleaned is greatly improved over conventional ultrasonic cleaning systems now in widespread industrial use.

Another object of this invention is to use a plurality of transducers assembled at various positions around the wall of a tank containing a cleaning liquid in combination with a source of electrical power and a selective switching system for the purpose of generating increased ultrasonic high intensity levels in the liquid by switching the electrical power selectivity, sequentially and intermittently to any specified one or more of said plurality of electroacoustic transducers.

Still another object of the invention is to make the side walls of the cleaning tank in the shape of a polygon and to mount the transducer elements on the side walls of the polygon to direct the ultrasonic output of the transducers along different paths through the cleaning liquid.

Another object of the invention is to design an ultrasonic cleaning system to include a storage tank for holding a cleaning fluid; a conduit to serve as a circulating system to transport the cleaning fluid from the storage tank into a first holding tank, then from the first holding tank into a second ultrasonic cleaning tank and finally from the ultrasonic cleaning tank through a filter for removing the dirt accumulated in the liquid by the ultrasonic cleaning of articles placed into the ultrasonic cleaning tank after which the circulating system returns the filtered cleaning fluid back into the storage tank to be continuously recirculated through the system.

Still another object of this invention is to design a completely portable, totally self-contained efficient ultrsonic cleaning system in which the ultrasonic intensity level in the cleaning liquid is greatly increased by the inventive system over conventional ultrasonic cleaning systems that operate at steady state cavitation levels.

These and other objects, features, and advantages of the invention will become more fully apparent from the following detailed description taken in conjunction with the accompanying drawings in which.

Figure 1:
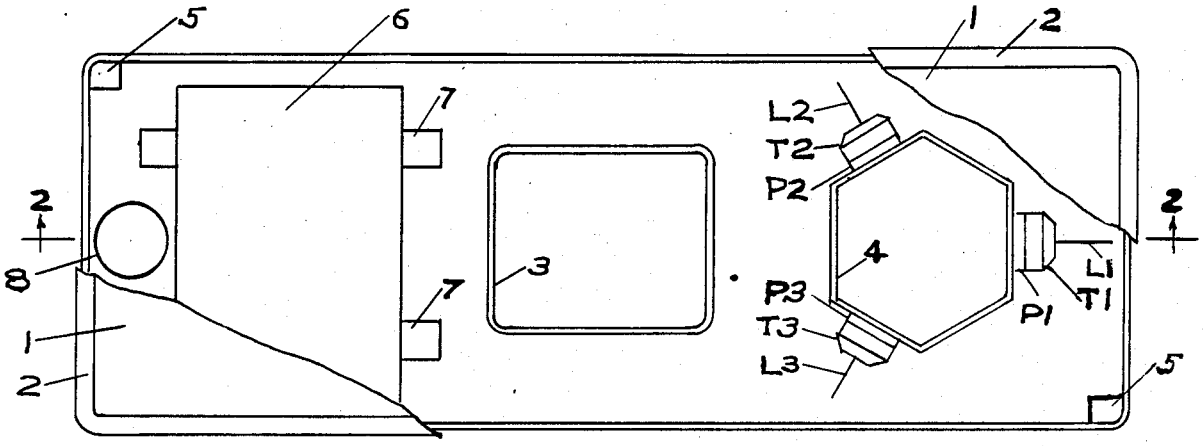
FIG. 1 is a pictorial schematic plan view of the inventive ultrasonic cleaning system which is illustrated by employing an hexagonal cleaning tank with three ultrasonic transducers mounted on three equally spaced positions around the periphery of the tank.
Figure 2:
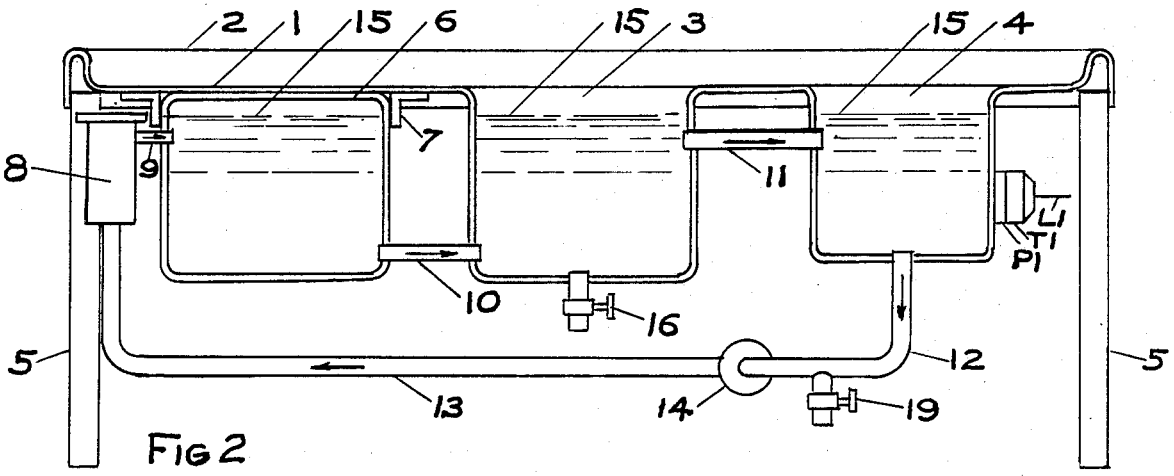
FIG. 2 is a schematic pictorial sectional view of the inventive ultrasonic cleaning system taken along the line 2—2 of FIG. 1.

Referring more specifically to the figures, the reference character 1 illustrates a flat tabletop surface shown in a partial cut-away view in FIG. 1 and in vertical section in FIG. 2. The tabletop may be made of sheet metal which is shown formed with an elevated ridge 2 around its outer periphery as illustrated. Also formed into the sheet metal surface are two open top tank-like containers 3 and 4 as shown. Although the tanks are shown as formed into the sheet metal, it is possible to form the tanks as separate components and solder or braze the open peripheries of the tanks to suitable openings cut into the surface of the tabletop structure 1. The purpose of the peripheral ridge portion 2 is to prevent any peripheral spilling of cleaning fluid that may drip onto the tabletop from the objects being subjected to the ultrasonic cleaning process. It is preferable to slightly taper the level of the top surface 1 toward the openings in tank 3 and 4 so that any cleaning liquid dripping over the top surface 1 will drain back into the tanks. Four support members 5 are attached to the four corners of the top structure 1 to act as legs for supporting the entire assembly.

Tank 4 serves as the ultrasonic cleaning tank. The tank is shown with hexagonal shaped sidewalls for illustrative purposes. However, the tank could be of any other desired shape such as a polygon with any number of sides or it could be of a tubular or circular shape with flat areas provided on the peripheral cylindrical wall to which the ultrasonic transducers would be attached. The illustrative hexagonal cleaning tank 4 shows three transducers T1, T2 and T3 mounted equally spaced around the periphery of the hexagonal tank. The three transducers as illustrated would be sufficient to achieve the advantages of this invention if the tank were relatively small, less than approximately 3 or 4 gallons in volume. For larger size tanks, clusters of several transducers could be placed on each of the three flat wall portions to replace the single transducers T1, T2 and T3 illustrated in FIG. 1. For still larger tanks, each flat wall portion of the tank 4 could be provided with a sufficient quantity of transducers to supply the increased sonic energy required for the larger volume of liquid contained in the larger tank.

Adaptor plates P1, P2 and P3 are soldered or brazed to the outer flat hexagonal surfaces of the tank 4 as illustrated. Each of the plates P1, P2 and P3 is provided with a threaded stud (not shown) projecting from the center of its outer flat unattached surface. A mating tapped hole is provided in the vibratile piston surface of each transducer to permit the convenient attachment of the sound radiating surfaces of the transducers to the surfaces of the adapter plates. A thin film of oil or silicone is preferably applied to the mating flat surfaces of the adapter plates and the transducer vibratile pistons before attaching the transducers to insure intimate contact with the mating surfaces to achieve efficient coupling for the transmission of the ultrasonic vibrations from the transducers through the tank wall.

A tank 3 is provided in the tabletop surface 1 to serve as a rinsing tank for rinsing the cleaned objects after they are subjected to the ultrasonic cleaning operation in tank 4. A storage tank 6 is attached to the bottom surface of tabletop 1 by means of the support members 7 as illustrated. The tank 6 acts as a reservoir for containing a supply of cleaning fluid. A filter 8 is placed between the ultrasonic cleaning tank 4 and the storage tank 6 as illustrated in FIG. 2. The three tanks and the filter are interconnected with a conduit transport system comprising the conduit sections 9, 10, 11, 12 and 13. A pump 14 is connected between the bottom of tank 4 and the bottom of filter 8 by means of the conduit sections 12 and 13, as illustrated, to maintain continuous circulation of the cleaning liquid throughout the system during operation.

The pump draws the dirty liquid from the bottom of cleaning tank 4 and sends it through the filter 8. The filtered cleaning fluid continues through the conduit section 9 and discharges into the reservoir tank 6. From tank 6, the filtered liquid passes through conduit 10 into rinsing tank 3 and then from tank 3 into ultrasonic cleaning tank 4 through the conduit section 11. When the pump is stopped or running at low speed as it would generally operate during small batch cleaning operations, the surface levels of the liquid 15 in each of the tanks 3, 4 and 6 will be the same. When the level of the surfaces in tanks 3 and 4 drops to a minimum established limit, additional cleaning fluid may be easily added by pouring it directly into rinsing tank 3 until the level is restored to the "full" condition. Drain valves 16 and 17 illustrated in FIG. 2 provide means for completely draining the system when it is desired to change the cleaning liquid or for any other reasons.

Figure 3:
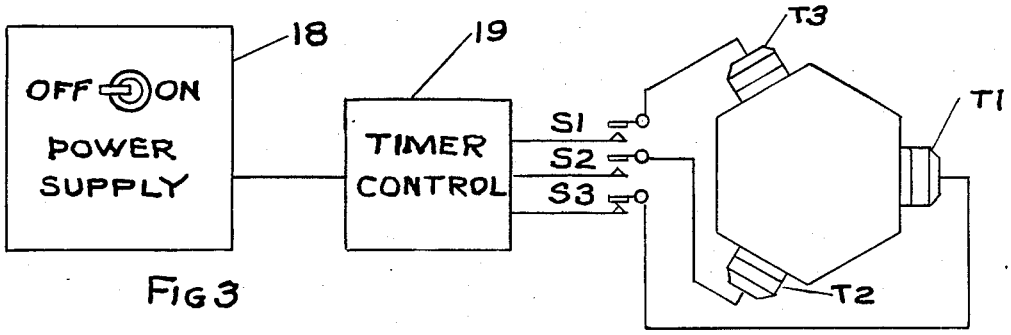
FIG. 3 illustrates a schematic wiring diagram for operating the ultrasonic cleaning system.

FIG. 3 shows a schematic diagram of the electrical power supply and switching system required for operating the inventive sonic cleaning system. A power supply 18 supplies the necessary electric power and frequency for operating the transducers. A plurality of switches S1, S2, S3 permit the connection of the electrical power to the transducers T1, T2, T3 individually or in selected groups as desired. The transducer electrical power is supplied selectively, sequentially and intermittently in accordance with any cyclic time sequence desired by controlling the periodic operations of the switches S1, S2, S3.

From experimental observations, I have found it possible to greatly improve the ultrasonic cleaning by establishing increased ultrasonic cavitation intensity levels during the first few seconds of applying the electrical power to the transducers. By switching the electrical power sequentially to different transducers every few seconds, the inventive system produces successive bursts of increased ultrasonic cavitation intensities through sequentially different paths in the cleaning liquid because of the successive quiescent states of the changing liquid paths being used in accordance with the teachings of this invention. The acoustic power densities that can be sustained at the transducer surfaces during the intermittent sequential operation of the different transducers as disclosed in this invention is in excess of 10 Watts peak per square inch of transducer radiating surface and in many cases in excess of 20 Watts peak per square inch of radiating surface.

The schematic block diagram illustrating the power supply 18, the switch timing programmer 19, and the switches S1, S2 and S3 do not show any specific details of the construction of these elements. The construction of any of these elements is not part of this invention. Each of the items are well known in the art and are readily available to any electronic technician. The switches, for example, could be standard electromagnetic relays or well known solid state switching devices. The timer 19 could be a simple motor driven mechanical clock mechanism that controls the "ON" and "OFF" timing sequence for the switches, such as is used for the operation of traffic lights.

The system as described and illustrated in FIGS. 1 and 2 employs a storage tank 6, a rinsing tank 3 and an ultrasonic cleaning tank 4. The use of the storage tank 6 is advantageous when the system is to be used for efficient production cleaning operations of moderate quantities of miscellaneous parts on a relatively continuous basis. For very large scale production cleaning, the tabletop assembly of small or medium sized tanks as illustrated in FIGS. 1 and 2 may be replaced by separate very large tanks which can accommodate very large structures to be cleaned such as completely welded automobile body subassemblies or welded unitized body assemblies. The welded body structures can be totally immersed in a large size tank equipped with a plurality of ultrasonic transducers mounted at various positions over the wall surfaces of the tank and capable of generating several kilowatts of ultrasonic power. The plurality of high-power transducers will be operated by supplying electrical power selectivity, sequentially and intermittently to any specified one or more of said plurality of transducers as taught above in the disclosure of this invention. After rapid thorough ultrasonic cleaning by the inventive high-efficiency cleaning system, an overhead conveyer will transport the body assembly from the cleaning tank to the rising tank and then from the rinsing tank directly to the painting operation, thereby eliminating the need for separately handling the cleaning and painting of separate body parts before assembly.

Structural details of the transducers, filter, pump, circulating system and power supply have been omitted because they are all very well known in the art and this invention is not concerned with the individual specific details of the structural components. The invention is in the new combination of the elements and in the unique operation of the inventive system as described to achieve a very good improvement over conventional ultrasonic cleaning systems that have been in widespead use for several decades.

Although a few specific examples have been given to illustrate the advantages of the disclosed invention, it should be understood that additional modifications and alternative constructions may be made without departing from the true spirit and scope of the invention. Therefore, the appended claims are intended to cover all such equivalent alternative constructions that fall within their true spirit and scope.

I claim:

1. In combination in a sonic cleaning system, a container including a bottom and a peripheral wall adapted for holding a liquid, a plurality of electroacoustic transducers, each transducer characterized in that it includes a vibratile surface adapted for transmitting sonic energy into high acoustic impedance medium such as a liquid, a plurality of transducer mounting means, each mounting means characterized in that it locates a different transducer at a different position on the peripheral wall surface of said container, a source of electrical power, switching means for selectively and intermittently connecting said source of electrical power to any specified one or more of said plurality of electroacoustic transducers for specified short intervals of time whereby to drive said transducer vibratile surfaces intermittently at high amplitudes sufficient to insonify a liquid placed in said container along the sound progagation paths of said transducers in said container at very high intensity levels sufficient to establish intense cavitation sound pressure levels in said liquid along said sound propagation paths of said transducers for said specified short intervals of time, said selective electrical switching means further characterized in that it includes control means for sequentially connecting said electrical power source among said plurality of transducer means in accordance with a specified cyclic periodic time sequence that selects sequential transducers for activation in such order that the intense cavitation level that existed along the propagation path of the next transducers to be activated has subsided.

2. The invention in claim 1 characterized in that the peripheral wall surface of said container includes a plurality of flat surfaces which, if extended to intersect one another, would to form a polygon.

3. The invention in claim 2 further characterized in that said polygon has 5 or more sides.

4. The invention in claim 2 further characterized in that said polygon is a pentagon.

5. The invention in claim 2 further characterized in that said polygon is a hexagon.

6. The invention in claim 1 further characterized in that said container wall surface is tubular in shape and still further characterized in that said plurality of transducers are spaced around the peripheral wall of said container.

7. The invention in claim 1 characterized in that said high intensity level is in excess of 10 watts peak per sq. in. of said vibratile surfaces of said transducers.

8. The invention in claim 7 further characterized in that said very high intensity level is at least 20 watts peak/sq. in. of said vibratile surfaces.

9. In combination in a sonic cleaning system, a first and a second open top tank adapted for holding a liquid, a storage tank for containing a cleaning liquid, a filter for removing dirt from a liquid, conduit means for transporting said cleaning liquid from said storage tank through said first and said second open top tanks; through said filter; and back to said storage tank, a pump associated with said conduit means, said pump characterized in that it is capable of maintaining a flow of cleaning liquid from said storage tank through said conduit means when said pump is activated, a plurality of electroacoustic transducers, a plurality of transducer mounting means, each mounting means characterized in that it serves to locate a different transducer at a different position along the wall surface of said second open top tank, said mounting means further characterized in that is does not inhibit the transmission of sonic energy from said mounted transducers into said cleaning liquid contained inside said second tank, a source of alternating electrical power of a frequency compatible with the operating frequency of said plurality of electroacoustic transducers, switching means for selectively and intermittently connecting said source of electrical power to any specified one or more of said plurality of electroacoustic transducers for specified short intervals of time whereby to drive said transducer vibratile surfaces intermittently at high amplitudes sufficient to insonify a liquid placed in said second tank at very high intensity levels along the sound propagation paths of said transducers in said liquid contained in said second tank for said short specified intervals of time, said selective electrical switching means further characterized in that it includes control means for sequentially connecting said electrical power source among said plurality of transducers in accordance with a specified cyclic periodic time sequence that selects sequential transducers for activation in such order that the intense cavitation level that existed along the propagation path of the next transducer to be activated has subsided.

10. The invention in claim 9 characterized in that the peripheral wall surface of said second tank includes a plurality of flat surfaces which, if extended to intersect one another would form a polygon.

11. The invention in claim 10 further characterized in that said polygon is a pentagon.

12. The invention in claim 10 further characterized in that said polygon is a hexagon.

13. The invention in claim 10 further characterized in that said polygon is an octagon.

14. The invention in claim 9 further characterized in that the wall surface of said second tank is tubular in shape and still further characterized in that said plurality of transducers are spaced around the circumference of said tubular wall surface.

15. The invention in claim 9 characterized in that said high intensity level is in excess of 10 watts per sq. in. of vibratile surface of said transducer.

16. The invention in claim 15 further characterized in that said high intensity level is at least 20 watts peak sq. in. of vibratile surface of said transducer.

17. The invention in claim 9 and a tablelike structure, mounting means associated with said tablelike structure for attaching the various elements recited in claim 9 to said tablelike structure, said first and said second open top tanks are located side by side on the table top surface of said tablelike structure whereby the top openings of said tanks are made accessible to an operator for immersing articles to be cleaned and rinsed.

18. The invention in claim 17 further characterized in that said filter is located between said second tank and said storage tank whereby the dirty liquid from said second tank is filtered clean before it is returned to said storage tank.

19. The invention in claim 17 characterized in that the wall surface of said second tank includes a plurality of flat surfaces which, if extended, will form a polygon and further characterized in that said high intensity level is in excess of 10 watts peak per sq. in. of vibratile surface of said transducer.

20. The invention in claim 19 further characterized in that said high intensity level is at least 20 watts peak per sq. in. of vibratile surface.

* * * * *